United States Patent [19]

Dittmar

[11] 4,096,778

[45] Jun. 27, 1978

[54] APPARATUS FOR PROCESSING TONE SIGNALS

[75] Inventor: Wilfried Dittmar, Halsenbach, Germany

[73] Assignee: WERSI-electronic GmbH & Co. Kommanditgesellschaft für elektronische Bauelemente, Halsenbach, Germany

[21] Appl. No.: 768,546

[22] Filed: Feb. 14, 1977

[30] Foreign Application Priority Data

Feb. 21, 1976 Germany ..... 2607136

[51] Int. Cl.[2] ..... G10H 1/02

[52] U.S. Cl. ..... 84/1.25; 84/1.2

[58] Field of Search ..... 84/1.2, 1.19, 1.24, 84/1.25

[56] References Cited

U.S. PATENT DOCUMENTS

| | | | |
|---|---|---|---|
| 2,835,814 | 5/1958 | Dorf | 84/1.25 |
| 3,524,376 | 8/1970 | Heytow | 84/1.25 |
| 4,031,795 | 6/1977 | Bunger | 84/1.24 |
| 4,044,643 | 8/1977 | Chase | 84/1.24 |

*Primary Examiner*—B. Dobeck
*Assistant Examiner*—Leonard Pojunas
*Attorney, Agent, or Firm*—Peter K. Kontler

[57] ABSTRACT

Apparatus for producing vibrato has several analog shift registers with at least $2^9$ stages whose inputs receive tone signals from an electronic musical device such as an organ or guitar and are connected to each other. The outputs of the shift registers are connected to a common amplifier. Each shift register receives tone signal transporting pulses from a discrete voltage-controlled high-frequency oscillator, and the inputs of the high-frequency oscillators receive control signals from discrete voltage-controlled low-frequency oscillators whose outputs transmit variable-frequency signals. The output signals of the low-frequency oscillators have different frequencies and are out of phase with respect to each other.

23 Claims, 2 Drawing Figures

APPARATUS FOR PROCESSING TONE SIGNALS

BACKGROUND OF THE INVENTION

The present invention relates to apparatus for processing tone signals, especially tone signals which are produced by electronic organs. More particularly, the invention relates to improvements in circuits for delayed transmission of tone signals wherein tone signals are transported by an analog shift register with a delay which is a function of the frequency at which the shift register receives pulses from a high-frequency oscillator and the latter receives signals from a low-frequency oscillator.

In accordance with a presently known proposal, the high-frequency oscillator receives signals from a voltage-controlled oscillator whose control voltage can be taken off a potentiometer and whose frequency can be varied between 0.6 and 6 Hz. The control signal is of sinusoidal shape and is applied to the high-frequency oscillator which transmits two series of square pulses phase shifted by one-half wave. The frequency of the pulses is a function of the amplitude of the control signals and is between 30 and 70 kHz. The pulses are transmitted to a commercially available analog shift register having 182 stages. The intervals which are needed for transport of a tone signal from the input to the output of the shift register depend on the frequency of applied pulses. The variations in length of intervals for transport of tone signals through the shift register result in phase modulation which, in turn, produces a vibrato effect. However, the tone of modulated signals is not satisfactory because it lacks the superposing and erasing effects which can be furnished by other tone processing apparatus, e.g., those utilizing a rotating loudspeaker.

It is further known to produce a complex vibrato signal by purely electronic means in that the tone signal is applied to an L-C time delay circuit having several outputs and the output signal is taken off seriatim from different outputs. In such delay circuits, each frequency is processed in a different way; furthermore, echoes develop at the open end of the delay circuit. This insures that the delay circuit furnishes not only a vibrato signal but also several additive and erasing effects, partly in imitation of a rotary loudspeaker and partly in the form of entirely new combinations.

It is further known to produce a string effect (in imitation of the entire string section of an orchestra) by transmitting the tone signal simultaneously to three analog shift registers. The control oscillators of the shift registers transmit identical control pulses but with a phase shift of 120°. Each control pulse consists of a first component having a frequency of at most 1 Hz and a second component having a frequency of 5–6 Hz.

SUMMARY OF THE INVENTION

An object of the invention is to provide a novel and improved apparatus for the processing of tone signals which are produced by electronic organs, guitars or analogous musical instruments.

Another object of the invention is to provide a simple and relatively inexpensive apparatus adapted to produce vibrato effects of a complexity which was heretofore achievable only by resorting to extremely complex components.

A further object of the invention is to provide an apparatus which, in addition to the just mentioned complex vibrato effect, can further produce other effects (such as fading) of the type not achievable with heretofore known apparatus for the processing of tone signals furnished by electronic organs or the like.

An additional object of the invention is to provide an apparatus which can be assembled of readily available and relatively inexpensive electrical and electronic components including integrated circuits.

Still another object of the invention is to provide an apparatus which, without resorting to time delay circuits, can produce vibrato effects similar or even superior to those produced by apparatus employing rotating loudspeakers.

The invention is embodied in an apparatus for the processing of tone signals, particularly tone signals which are produced by an electronic organ. The apparatus comprises a plurality of delay circuits including a first and a second delay circuit each having a multistage analog shift register with a tone signal receiving input and an output for delayed transmission of tone signals, a low-frequency oscillator including an output for transmission of variable-frequency control signals (the signals at the outputs of the low-frequency oscillators and are out of phase with respect to each other), and a high-frequency oscillator having an input connected to the output of the respective low-frequency oscillator and output means (e.g., two outputs) for transmission of variable-frequency tone signal transporting pulses to the respective shift register whereby the frequency of such pulses and the intervals of transport of tone signals through the shift registers vary as a function of variations of amplitude of the respective control signals. The apparatus further comprises means for respectively connecting the inputs and outputs of the shift registers to each other.

The apparatus may comprise more than two delay circuits each of which includes a shift register, a low-frequency oscillator and a high-frequency oscillator. The tone signal which passes through two or more shift registers is phase-modulated and the tone signals in each of the channels are shifted in phase with respect to each other. The tone signals at the outputs of the shift registers produce highly interesting sound effects as a result of addition and erasure of such signals. A uniform vibrato effect cannot be discerned if the delay produced by each of the shift registers is equally pronounced. This is counteracted by selection of different amplitudes of the control signals and hence of different modulation strokes; as a result of such selection, one of the delay circuits plays a dominant role and furnishes a pronounced basic vibrato effect. Highly satisfactory results are obtained if the control signals have a sinusoidal shape and are shifted by 360°/n wherein $n$ is the number of delay circuits. A highly complex output tone signal is obtained by resorting to a rather simple apparatus if the number of delay circuits equals three, i.e., if the phase shift equals 120° and if each of the three effective control signals has a different amplitude.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
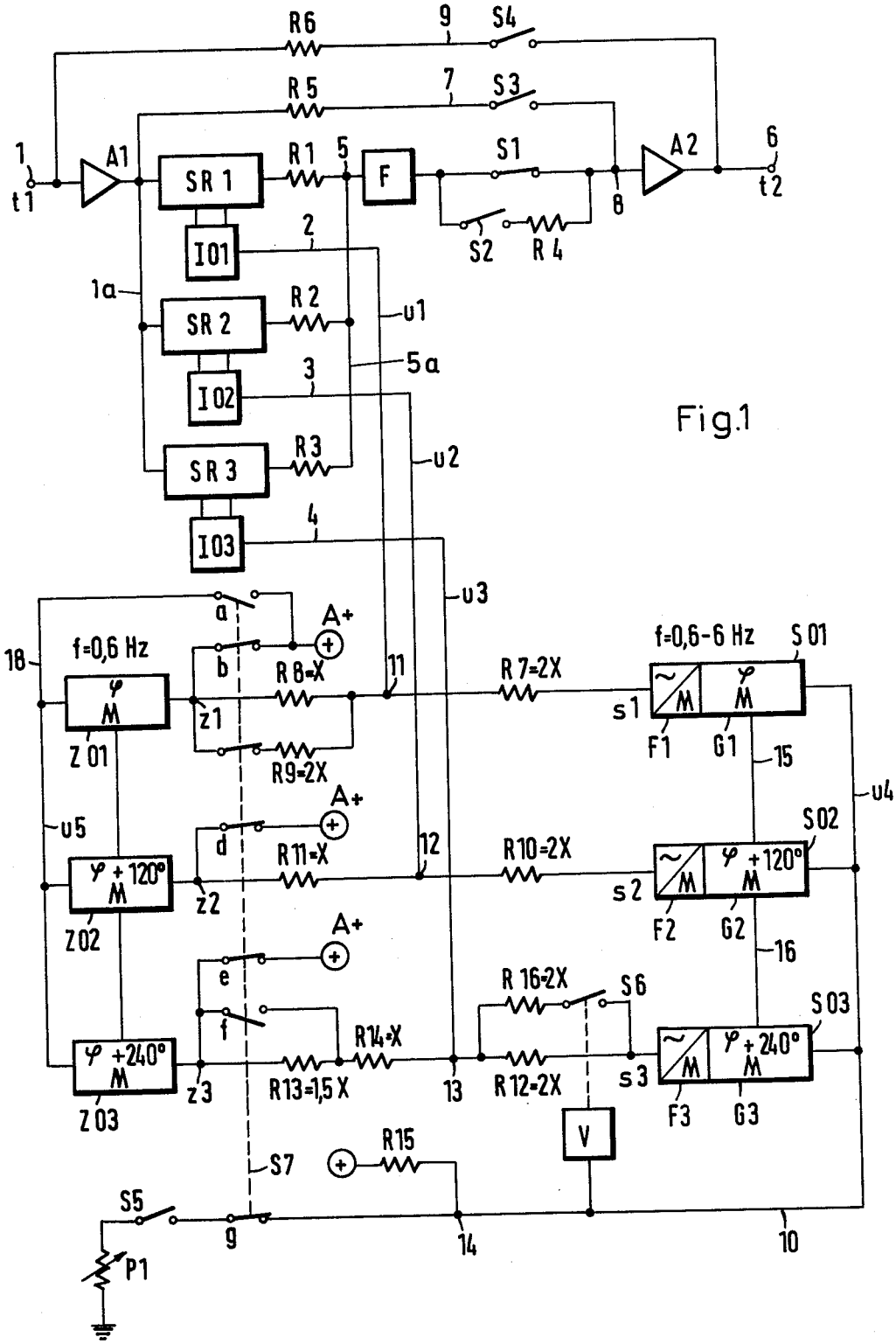
FIG. 1 is a circuit diagram of an apparatus which embodies the invention.

Referring to FIG. 1, there is shown an apparatus for the processing of tone signals *t*1 which are transmitted by a musical instrument (not shown), preferably by an electronic organ. However, it is equally within the purview of the invention to process tone signals which are furnished by other types of instruments, for example, by a guitar. The tone signal *t*1 is applied to an input 1 and is amplified by an amplifier A1 which transmits the amplified tone signal to the inputs of three analog shift registers SR1, SR2 and SR3 via conductor 1*a*. Each of the shift registers SR1–SR3 may constitute a commercially available integrated circuit with at least $2^9$ stages; as a rule, such shift registers operate on the bucket brigade principle and their switching elements may constitute field effect transistors.

The shift registers SR1, SR2, SR3 are respectively associated with control pulse oscillators IO1, IO2, IO3 each of which has two outputs for transmission of square wave control pulses to the respective shift register for transport of tone signals from the inputs to the outputs of such shift registers. The pulses which are transmitted by the outputs of each oscillator are shifted in phase by one-half wave. The frequency of oscillators IO1–IO3 (each of which is a voltage controlled oscillator) is determined by the respective control voltages *u*1, *u*2, *u*3 which are applied to the inputs of the oscillators IO1, IO2 and IO3 via conductors 2, 3 and 4 respectively. By varying such frequency, one can change the length of interval for transport of a tone signal from the input to the output of the respective shift register.

The outputs of the shift registers SR1, SR2, SR3 respectively transmit delayed tone signals to resistors R1, R2, R3 all of which are connected by conductor 5*a* to a common tone signal mixing junction 5. The resulting mixture of delayed tone signals is transmitted to a high-frequency filter F which, in turn, transmits the thus obtained tone signal *t*2 to the output terminal 6 by way of a switch S1 and an amplifier A2. The switch S1 is connected in parallel with a second switch S2 which is in series with a resistor R4. A conductor 7 which contains a resistor R5 and a switch S3 connects the output of the amplifier A1 with a terminal 8 at the input of the amplifier A2 so that, when the switch S3 is closed, a portion of the amplified input tone signal *t*1 can be mixed with the non-amplified output tone signal intermediate the switch S1 and amplifier A2. A feedback conductor 9 connects the output of the amplifier A2 with the input of the amplifier A1 through switch S4 and resistor R6 so that, when the switch S4 is closed, a portion of the amplified output tone signal *t*2 can be transmitted to the input 1 by way of resistor R6.

The tone signal processing apparatus further comprises three voltage operated control signal oscillators SO1, SO2, SO3 which respectively transmit sinusoidal control signals *s*1, *s*2, *s*3. The control signal oscillators SO1, SO2, SO3 respectively comprise triangular voltage generators G1, G2, G3 and sine wave forming circuits F1, F2, F3. The frequency of oscillator circuits SO1–SO3 is determined by control voltage *u*4 which is applied to a control conductor 10 common to all three control signal oscillators. These oscillators are connected to each other in such a way that their sinusoidal vibrations are shifted in phase by 120°.

The control voltage *u*1 is taken off the tap 11 of a first voltage divider which is connected between the output of the oscillator SO1 and the positive pole A+ of an energy source. The first voltage divider comprises three resistors including a first resistor R7 connected in series with two additional parallel connected resistors R8, R9.

The control voltage *u*2 is taken off the tap 12 of a second voltage divider which is connected between the output of the oscillator SO2 and the positive pole A+ of the energy source; this second voltage divider comprises two resistors R10 and R11.

The control voltage *u*3 is taken off the tap 13 of a third voltage divider which is connected between the output of the oscillator SO3 and the positive pole A+ of the energy source; the third voltage divider comprises a first resistor R12 and two additional resistors R13 and R14 connected in series.

If the resistance of the resistor R8 equals X ohms, the resistance of resistors R11, R14 also equals X ohms, the resistance of the resistor R13 equals 1.5X ohms, and the resistance of resistors R7, R9, R10, R12 equals 2X ohms. It will be noted that each of the three voltage dividers has a different resistance ratio and that the voltage signals *u*1, *u*2, *u*3 constitute effective control signals whereby the amplitude of i u2 exceeds the amplitude of *u*1 but is less than the amplitude of *u*3.

The three voltage dividers constitute a very simple and inexpensive means for furnishing three different effective control voltages (*u*1–*u*3) by taking such voltages off the taps of the corresponding voltage dividers (each of which has a different resistance ratio).

The control voltage *u*4 is taken off the tap 14 of an additional voltage divider which is connected between the poles of the energy source and comprises a resistor R15 and a potentiometer P1. The potentiometer P1 is connected in series with a switch S5. When the switch S5 is open, the voltage *u*4 equals the positive voltage of the energy source; such maximum voltage *u*4 causes the outputs of the oscillators SO1, SO2, SO3 to transmit control signals *s*1, *s*2, *s*3 of fixed maximum frequency (e.g., approximately 6 Hz). When the switch S5 is closed, the voltage *u*4 is determined by the potentiometer P1 which is adjustable. Therefore, the frequency of control signals *s*1, *s*2, *s*3 is reduced according to the position of the potentiometer. By appropriate adjustment of the potentiometer P1, such frequency can be reduced to 0.6 Hz, i.e., to approximately one-tenth of the maximum frequency. Thus, by opening or closing the switch S5 and by adjusting the potentiometer P1, one can change the speed of vibrato. When the control voltage *u*4 is low, the vibrato is slower and the speed of vibrato increases when the control voltage *u*4 increases.

The resistor R12 of the third voltage divider can be connected in parallel with or bypassed by a further resistor R16 (having a resistance equal to 2X) by closing a switch S6. Switch S6 is governed by the output of a comparator circuit V which monitors the control voltage *u*4 and automatically closes the switch S6 at low frequencies, i.e., when the voltage *u*4 is less than a predetermined threshold value. By closing the switch S6, the amplitude of the effective control signal *u*3 is increased still further. The resistor R16 can be connected in series with a further resistor (not shown) which is bypassed on closing of the switch S6.

The apparatus of FIG. 1 further comprises three auxiliary oscillators ZO1, ZO2, ZO3 each of which constitutes a voltage-regulated triangular voltage generator and which furnish triangular shaped additional or auxiliary signals *z*1, *z*2, *z*3 having a fixed low frequency $f = 0.6$ Hz and being shifted in phase with respect to each other by 120°. As a rule, the auxiliary oscillators are inactive; they can be connected in circuit with the respective voltage dividers by closing a multi-ganged switch S7. The switch S7 has several contacts including a contact *a* which can connect the inputs of the auxiliary oscillators to the positive pole A+ of the energy source by way of a conductor 18, i.e., a control voltage *u*5 is then applied to the inputs of all three auxiliary oscillators. When the switch S7 is acutated, i.e., when the contact *a* is closed, the contacts *b*, *d* and *e* of the switch S7 disconnect the respective (first, second and third) voltage dividers from the positive pole A+ of the energy source. At the same time, the contact *c* of the switch S7 opens the circuit of the resistor R9 and the contact *f* of the switch S7 completes a bypass line for the resistor R13. Finally, the contact *g* of the switch S7 disconnects the potentiometer P1 from the tap 14 of the additional voltage divider. Consequently, the outputs of the auxiliary oscillators ZO1, ZO2, ZO3 are respectively connected with identical resistors R8, R11, R14 whose ohmic resistance is one-half that of the resistors R7, R10, R12 (the latter resistors are connected with the outputs of the oscillators SO1, SO2, SO3). Consequently, the auxiliary signal *z*1 is mixed proportionally with the fixed control signal *s*1 at the tap 11, the auxiliary signal *z*2 is mixed proportionally with the fixed control signal *s*2 at the tap 12, and the auxiliary signal *z*3 is mixed proportionally with the fixed control signal *s*3 at the tap 13. Therefore, each of the three control voltages *u*1, *u*2, *u*3 then consists of basic oscillations (represented by auxiliary signals) which are phase shifted by 120° and each of which is modulated by the respective control signal *s*1, *s*2, *s*3. The frequency of signals *s*1, *s*2, *s*3 is then higher than that of auxiliary signals *z*1, *z*2, *z*3. The apparatus then furnishes a string effect. The inputs of oscillators IO1–IO3 then receive control voltages each of which is the sum of a control signal and an auxiliary signal. Save for the phase shift, the conditions for each of the three shift registers are identical when the apparatus furnishes a string effect. The taps 11, 12 and 13 then constitute a means for mixing the control signals *s*1–*s*3 with the respective auxiliary signals *z*1–*z*3. As mentioned above, the resistance of each of the resistors R7, R10, R12 (which receive signals from the outputs of the oscillators SO1–SO3) exceeds the resistance of resistors R8, R11, R14 (which receive signals from the outputs of the oscillators ZO1–ZO3). Consequently, the amplitude of signals *z*1–*z*3 exceeds the amplitude of signals *s*1–*s*3 and the influence of signals *z*1–*z*3 is greater than that of the signals *s*1–*s*3.

Figure 2:
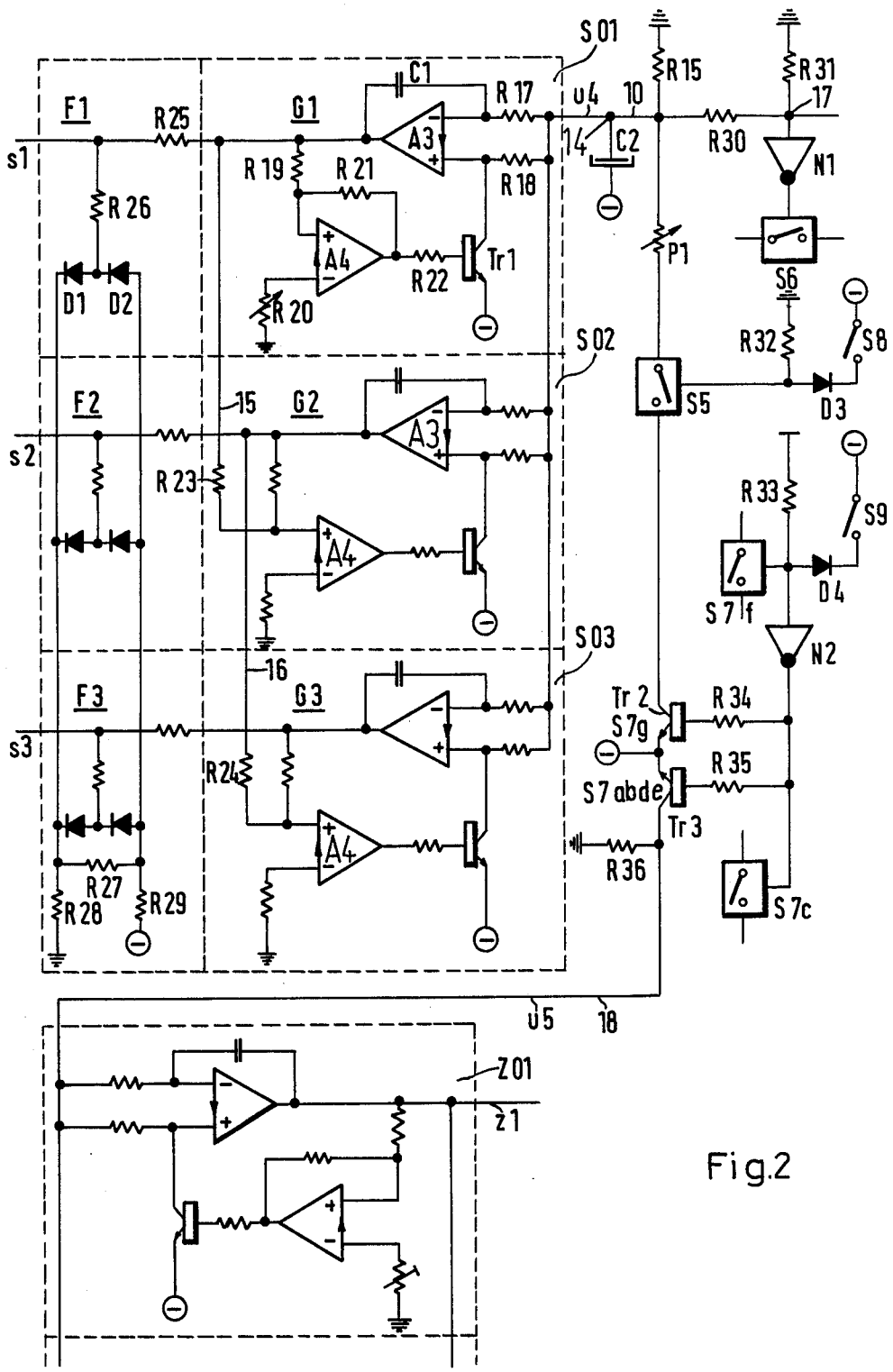
FIG. 2 is a circuit diagram depicting in more detail certain components of the circuit of FIG. 1 wherein electronic switches are substituted for the mechanical switch elements of FIG. 1.

FIG. 2 shows the details of a portion of the circuit of FIG. 1. The only difference between the arrangements of FIGS. 1 and 2 is that the structure shown in FIG. 2 employs electronic switches and the energy source operates between zero and minus instead of between plus and zero (as shown in FIG. 1). All such parts of the apparatus of FIG. 2 which are identical with or clearly analogous to the corresponding elements of the apparatus of FIG. 1 are denoted by similar reference characters.

The triangular voltage generator G1 of the control signal oscillator SO1 of FIG. 2 comprises a first operational amplifier A3 which, in view of the provision of a capacitor C1, performs the function of an integrator circuit. The two inputs of the operational amplifier A3 are connected to the conductor 10 (to which is applied the control voltage *u*4 by way of two resistors R17, R18 having different resistances). The feedback connection from the output of the operational amplifier A3 comprises a second operational amplifier A4 whose positive input is connected with the output of the amplifier A3 by a resistor R19. The negative input of the operational amplifier A4 is connected to the ground by way of a variable resistor R20. A further resistor R21 is connected in a feedback connection between the output and the positive input of the second operational amplifier A4. The output of the amplifier A4 is further connected to the base of a transistor Tr1 by way of a resistor R22. The emitter of the transistor Tr1 is connected to the negative pole of the energy source and its collector is connected to the positive input of the first operational amplifier A3. The just described circuit furnishes a triangular voltage waveform whose frequency is a function of the control voltage *u*4.

The construction of the generator G2 of the control signal oscillator SO2 is similar to that of the just described generator G1 of the oscillator SO1. The only difference is that the feedback resistor R21 of the generator G1 is omitted in the generator G2. Instead, the positive input of the second operational amplifier A4 of the generator G2 is connected with the output of the amplifier A3 in the generator G1 by way of a conductor 15 which contains a coupling resistor R23. By appropriate dimensioning, one can insure that, independent of the frequency, the generator G2 is always operated with a phase shift of 120°. A similar conductor 16 contains a coupling resistor R24 and connects the output of the first operational amplifier A3 of the generator G2 with the positive input of the second operational amplifier A4 of the generator G3 in the oscillator SO3. This insures that the phase shift between the signals from the generators G2, G3 also equals 120°.

The utilization of triangular-voltage generators in the control signal oscillators SO1–SO3 as well as in the auxiliary oscillators ZO1–ZO3 contributes to simplicity of such oscillators. In such generators, the shift in phase is achieved by effecting a comparison with the output voltage of the neighboring oscillator. Since the output voltage rises linearly, the desired phase shift can be determined by selection of a fixed value for the output voltage. Such selection is not dependent on the frequency to which the respective oscillator is tuned.

It has been found that a triangular signal is just as satisfactory or nearly as satisfactory as a sinusoidal signal. Therefore, the signals at the outputs of the triangular-voltage generators can be used as auxiliary signals *z*1–*z*3. However, the control signals are preferably sinusoidal. Therefore, the generators G1–G3 of the oscillators SO1–SO3 are preferably associated with the aforementioned means F1–F3 for trimming the triangular signals so as to convert such signals into sinusoidal signals.

It is presently preferred to utilize shift registers each of which comprises at least $2^9$ stages and the frequency of each of the high-frequency oscillators IO1–IO3 is preferably variable between 70 and 200 kHz. This insures that the switching frequency of each shift register is a multiple of the tone signal frequency without reducing the intervals of delay. This insures that the characteristic noise of the shift registers is minimal.

The sine wave forming circuits F1, F2 and F3 of the oscillators SO1–SO3 comprise longitudinal resistors R25, transverse resistors R26 and pairs of diodes D1, D2. The diodes bridge a central resistor R27 of a voltage divider which is connected between the poles of the energy source and further includes the resistors R28 and R29. Such arrangement insures a clipping of the triangular voltages from above and from below which results in the formation of a sinusoidal curve.

The construction of auxiliary oscillators ZO1, ZO2 and ZO3 corresponds of that of the generators G1 to G3. FIG. 2 merely shows the construction of the first auxiliary oscillator ZO1.

FIG. 2 further shows that the conductor 10 is connected with a capacitor C2 which renders it possible to gradually increase the control voltage *u*4 so as to facilitate the imitation of the speed up effect of a rotary loudspeaker. The imitation of the slow down rotation takes place much faster because of the low value of the potentiometer P1.

The switch S6 is controlled by an inverter N1 whose input is connected to the tap 17 of a voltage divider between the conductor 10 and the ground. This voltage divider comprises two resistors R30 and R31. When the voltage at the tap 17 drops below the input threshold value of the gate N1, the output of the gate N1 transmits a signal which closes the switch S6.

The electronic switch S5 is energizable by a mechanically actuatable electric switch S8. When the switch S8 is closed, a current flows through a resistor R32 and a diode D3 whereby the current energizes the switch S5.

Closing of a further mechanically actuatable switch S9 results in the flow of current through a resistor R33 and a diode D4. This renders the contact *f* of the switch S7 conductive. At the same time, an inverter N2 causes the contact *c* of the switch S7 to block. The same applies for the transistors Tr2 and Tr3 whose bases are connected to the output of the inverter N2 by resistors R34, R35. The transistor Tr2 replaces the contact *g* of the switch S7 of FIG. 1, and the transistor Tr3 replaces the contacts *a, b, d* and *e* of the switch S7 shown in FIG. 1. When the transistor Tr3 blocks, the control voltage *u*5 which is applied to the conductor 18 equals the ground potential which is applied via resistor R36 and effects the generation of the auxiliary signal *z*1. When the transistor Tr3 is conductive, the value of *z*1 equals the negative potential. Such negative potential automatically raises the voltage at the outputs of oscillators ZO1–ZO3 due to the presence of aforesdescribed operational amplifiers. The ground potential corresponds to the positive potential in the apparatus of FIG. 1.

When the electronic switch S7 of FIG. 2 is not energized, the circuitry of FIG. 2 operates in such a way that the phase modulation furnishes a vibrato effect. The tone signals *t*1 are delayed in each of the shift registers SR1–SR3. The delay times vary periodically in dependency on the effective control signals *u*1, *u*2 and *u*3. This results in a phase modulation in each of the three channels and such phase modulations are offset by 120°. However, the modulation strokes are different. For example, the control pulse frequency in the oscillator IO3 for the first shift register SR3 varies between 140 and 200 kHz, between 160 and 200 kHz in the oscillator IO2, and between 180 and 200 kHz in the oscillator IO1. Since the differently processed tone signals are thereupon mixed with each other, there develop pronounced additions and erasures, i.e., a very lively and pleasant vibrato. The pronounced vibrato characteristic persists because of the preselected dominance of the shift register SR3.

If the switch S4 is closed at the same time, a portion of the output tone signal *t*2 is fed back to the input 1 and passes through the shift registers for a second time. This furnishes a very lively and variegated celeste-vibrato effect with pronounced resonance portions, i.e., a different resonance frequency for each shift register, such as were heretofore obtainable only electronically by resorting to a LC-time delay circuit.

When the switches S1 and S4 are open and the switch S2 or the switches S2 and S3 are closed, one obtains a chorus-vibrato effect because a portion of the input signal, in unchanged form, is mixed with the processed tone signal.

When the electronic switch S5 is open, the frequency of control pulse oscillators SO1–SO3 is 6 Hz. When the electronic switch S5 is conductive (in FIG. 2, energization of the switch S5 takes place in response to closing of the mechanically actuatable switch S8), the control pulse oscillators receive a lower voltage so that their frequency is determined by the potentiometer P1. When the voltage drops below a predetermined value, the switch S6 is energized which results in an increase of modulation stroke for the shift register SR3, i.e., the dominance of the shift register SR3 is more pronounced. This is of advantage for a slow but pronounced rotational effect, i.e. an effect resembling that furnished by a slowly revolving speaker.

The electronic switch S7 which, in the embodiment of FIG. 2, is energizable by the mechanically acutuatable switch S9, causes that the control voltages *u*1–*u*3 are not a fraction of the control signals *s*1–*s*3 but rather a mixture of auxiliary signals *z*1–*z*3 and control signals *s*1–*s*3. In such event, the control voltages *s*1–*s*3 are equal to each other and are merely shifted in phase. This furnishes a string effect.

When the switch S4 in the feedback conductor 9 is closed at the time the system furnishes a string effect, one obtains a fading effect which is a novel effect in connection with electronic musical instruments. The apparatus can be provided with means for energizing the switch S7 simultaneously with the switch S4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for the processing of tone signals, particularly tone signals which are produced by electronic organs, comprising a plurality of delay circuits including a first and a second delay circuit each having a multi-stage analog shift register including a tone signal receiving input and an output for delayed transmission of tone signals, a low-frequency oscillator including an output for transmission of variable-frequency control signals, the control signals at the outputs of said oscillators being out of phase with respect to each other, and a high-frequency oscillator having an input connected to the output of the respective low-frequency oscillator and output means for transmission of variable-frequency tone signal transporting pulses to the respective shift register whereby the frequency of said pulses and the intervals of transport of tone signals through said shift registers vary as a function of variations of amplitude of the respective control signals; and means for respectively connecting the inputs and outputs of said shift registers to each other.

2. Apparatus as defined in claim 1, wherein said control signals are substantially sinusoidal signals and are out of phase by 360°/n, n being the number of said delay circuits.

3. Apparatus as defined in claim 1, wherein said delay circuits further include a third delay circuit and the amplitude of control signals at the output of the low-frequency oscillator of said third delay circuit is different from the amplitudes of the other control signals, said control signals being out of phase by 120°.

4. Apparatus as defined in claim 1, further comprising an energy source and a plurality of voltage dividers, each of said voltage dividers being connected between said source and the output of one of said low-frequency oscillators, each of said voltage dividers having a tap connected to the input of the respective high-frequency oscillator and each of said voltage dividers having a different resistance ratio.

5. Apparatus as defined in claim 1, further comprising a feedback connection from the outputs to the inputs of said shift registers.

6. Apparatus as defined in claim 1, further comprising means for connecting the inputs of said shift registers with the outputs of said shift registers so as to mix unprocessed tone signals with delayed tone signals.

7. Apparatus as defined in claim 1, wherein each of said shift registers comprises at least $2^9$ stages.

8. Apparatus as defined in claim 1, wherein the frequency of each of said high-frequency oscillators is variable between 70 and 200 kHz.

9. Apparatus as defined in claim 1, wherein each of said low-frequency oscillators comprises a triangular voltage generator and the phase shift is effected by comparison of voltage with the output voltage of the neighboring low-frequency oscillator.

10. Apparatus as defined in claim 9, wherein each of said low-frequency oscillators further comprises means for converting the voltage signal furnished by the respective generator into a substantially sinusoidal control signal.

11. Apparatus as defined in claim 1, further comprising means for increasing the differences in amplitude of said control signals when the frequency of such signals is below a predetermined threshold value.

12. Apparatus as defined in claim 7, wherein said low-frequency oscillators are voltage regulated oscillators and have inputs for the application of control voltage, and further comprising a source of variable control voltage, said means for increasing the difference in amplitude of said control signals including switch means responsive to a predetermined drop of said control voltage.

13. Apparatus as defined in claim 12, further comprising an energy source and a discrete voltage divider connected between said energy source and the output of each of said low-frequency oscillators, said voltage dividers having taps connected to the inputs of the respective high-frequency oscillators and each of said voltage dividers having a different resistance ratio, one of said voltage dividers comprising a first resistor connected between the respective tap and the output of the respective low-frequency oscillator and a second resistor, said switch means being operative to connect said second resistor in parallel with said first resistor in response to said drop in control voltage.

14. Apparatus as defined in claim 1, wherein each of said low-frequency oscillators is a voltage operated oscillator having an input and further comprising a source of control voltage and means for connecting said source to the inputs of said low-frequency oscillators, said source including a voltage divider having a tap connected to the inputs of said low-frequency oscillators, an energy source, resistor means connected between one pole of said energy source and said tap, a potentiometer and switch means connecting said potentiometer to said tap.

15. Apparatus as defined in claim 14, further comprising capacitor means connected between the other pole of said energy source and said tap.

16. Apparatus as defined in claim 1, further comprising an auxiliary oscillator for each of said delay circuits, each auxiliary oscillator having an output for transmission of a fixed low-frequency auxiliary signal, and switch means having means for raising the frequencies of said control signals above the frequencies of the respective auxiliary signals and means for connecting the outputs of said low-frequency oscillators with the outputs of the respective auxiliary oscillators.

17. Apparatus as defined in claim 16, wherein each of said low-frequency oscillators is a voltage operated oscillator and comprises an input for reception of a voltage signal, and further comprising means for supplying said voltage signal including a potentiometer, said means for raising the frequencies of said control signals including a switch portion in series with said potentiometer.

18. Apparatus as defined in claim 17, further comprising a voltage divider for each of said delay circuits, each of said voltage dividers being connected between the outputs of the respective low-frequency and auxiliary oscillators and having a tap connected to the input of the respective high-frequency oscillator, and a source of energy having a pole normally connected with each of said taps, said last mentioned connecting means including additional switch portions actuatable to disconnect said pole from said taps and to simultaneously connect said taps with the outputs of the respective auxiliary oscillators.

19. Apparatus as defined in claim 18, wherein each of said voltage dividers further comprises a resistor normally connected between said pole and the respective tap and being in series with the output of the respective auxiliary oscillator on actuation of said additional switch portions, said resistors having identical ohmic resistances.

20. Apparatus as defined in claim 19, wherein each of said voltage dividers further comprises an additional resistor connected between the respective tap and the output of the respective low-frequency oscillator, said additional resistors having identical ohmic resistances.

21. Apparatus as defined in claim 20, wherein the resistances of said additional resistors exceed the resistances of said first mentioned resistors.

22. Apparatus as defined in claim 16, further comprising a feedback connection from the outputs of said shift registers to the inputs of said shift registers, said feedback connection including normally open second switch means and further comprising means for closing said second switch means simultaneously with actuation of said first mentioned switch means to connect the outputs of said auxiliary oscillators with the outputs of the respective low-frequency oscillators.

23. Apparatus as defined in claim 16, wherein each of said auxiliary oscillators comprises a triangular voltage generator and the phase shift is effected by comparison of voltage with the output voltage of a neighboring auxiliary oscillator.

* * * * *